US005979550A

United States Patent [19]

Tessier

[11] Patent Number: 5,979,550

[45] Date of Patent: Nov. 9, 1999

[54] PC PUMP STABILIZER

[75] Inventor: Lynn P. Tessier, Cochrane, Canada

[73] Assignee: Alberta Ltd., Calgary, Canada

[21] Appl. No.: 09/028,803

[22] Filed: Feb. 24, 1998

[51] Int. Cl.[6] ..... E21B 23/00

[52] U.S. Cl. ..... 166/212; 166/206; 166/214; 166/382; 166/383

[58] Field of Search ..... 166/206, 212, 166/381, 382, 383

[56] References Cited

U.S. PATENT DOCUMENTS

| | | | |
|---|---|---|---|
| 1,856,469 | 5/1932 | Crowell | 166/214 |
| 2,490,350 | 12/1949 | Grable et al. | 166/193 |
| 3,661,205 | 5/1972 | Belorgey | 166/66.4 |
| 3,891,034 | 6/1975 | Owen et al. | 166/285 |
| 4,184,546 | 1/1980 | Nicholas et a. | 166/206 |
| 4,616,703 | 10/1986 | Laurent et al. | 166/66.4 |
| 4,776,394 | 10/1988 | Lynde et al. | 166/55.8 |
| 4,960,173 | 10/1990 | Cognevich et al. | 166/241.1 |
| 5,678,633 | 10/1997 | Constantine, Jr. | 166/319 |
| 5,758,723 | 6/1998 | Saucier et al. | 166/55.8 |
| 5,765,640 | 6/1998 | Milne et al. | 16/206 |

*Primary Examiner*—David Bagnell
*Assistant Examiner*—Chi H. Kang
*Attorney, Agent, or Firm*—Millen, White, Zelano & Branigan, P.C.

[57] ABSTRACT

Apparatus is provided for stabilizing a PC pump suspended from production tubing. The stabilizing apparatus is connected to the pump and comprises a tubular body having a cylindrical wall, a longitudinal bore contiguous with the production tubing and three or more circumferentially-spaced linkages are disposed in longitudinal slots formed in the exterior of the tubular body. Each linkage comprises at least a passive and an active link pivotally connected end-to-end in series, the passive link being pivoted from the body. An annulus is formed within the cylindrical wall and contains a longitudinally movable annular piston pivotally connected to the active link. The annulus is connected to the bore so that the piston is pressurized dynamically with fluid from the bore. Fluid pressure drives the piston, actuating the active link, thereby causing the linkage to expand radially outwards, the radial force being proportional with the fluid pressure. Under production pressures, a very high stabilizing force is produced. Accordingly, at non-flowing conditions, the pressure diminishes and the linkages are only spring-loaded, permitting movement of the pump and tubing while maintaining tool and apparatus centralization.

8 Claims, 3 Drawing Sheets

PC PUMP STABILIZER

FIELD OF THE INVENTION

The invention relates to a dynamic pressure-responsive tool used for the stabilization and centralization of tools suspended from production tubing, said tools being subject to undesirable lateral movement, more particularly tools subject to vibration in operation such as progressive cavity pumps.

BACKGROUND OF THE INVENTION

Apparatus are known for stabilizing various well tools which are suspended at the bottom of a production tubing string. An example of a tool which would benefit from stabilization is a progressive cavity pump ("PC pump"). A PC pump is located within an oil well, positioned at the bottom end of a production string which extends down the casing of the well. The pump pressurizes well fluids and drives the up the bore of the production string to the surface. The pump comprises a pump stator coupled to the production tubing string, and a rotor which is both suspended and rotationally driven by a sucker rod string extending through the production string bore. The stator is held from reactive rotation by a tool anchored against the casing. Usually this anti-reactive, or no-turn tool is located at the base of the stator. Typically a no-turn tool applies serrated slips to grip against the casing.

The rotor is a helical element which rotates within a corresponding helical passage in the stator. Characteristically, the rotor does not rotate concentrically within the stator but instead scribes a circular or elliptical path. This causes vibration and oscillation of the sucker rod, the pump's stator and the tubing attached thereto.

The greater the pump flow, the greater is the vibration. This can lead to loosening of the slips and functional failure of the no-turn tool. Other problems include fatigue failure of the connection of the stator to the tubing or nearby tubing-to-tubing connections.

In the prior art, bow springs have typically been used to centralize and stabilize the stator and the supporting tubing. By design, the bow springs are radially flexible, in part to permit installation and removal through casing. Unfortunately, the spring's flexibility permits cyclic movement, resulting in fatigue and eventual failure of the springs.

Unitary tubing string centralizers generally position the tool in a concentric or central position in the well. While these centralizers may provide positioning function, they are not effective as a tool-stabilizing means. The known centralizers are passive devices and do not actively contact the casing.

More sophisticated apparatus are known which more positively secure and position tools within a well. For example, in U.S. Pat. No. 2,490,350 to Grable, a centralizer is provided using mechanical linkages which lock radially outwardly to engage the casing. Each of a plurality of two-bar linkages is held tight to the outside of the tubing string with a retaining bolt. A longitudinal spring and longitudinal ratchet are arranged external to the tubing for pre-loading of one link with the potential to jack-knife the linkage outwardly, except for the restraining action of the retaining bolt. A radial plunger extends through the tubing wall to contact the linkage. The plunger has limited stroke. When the tubing string bore is pressurized, the plunger urges the linkage sufficiently outwardly to break the retaining bolt, permitting the spring to drive the linkage radially outwardly. The driven link engages the ratchet, ensuring the linkage movement is uni-directional.

In U.S. Pat. No. 4,960,173 to Cognevich, a tubular housing is also disclosed having mechanical linkages which are held tight to the housing during installation. The linkages are irreversibly deployed upon melting of a fusible link at downhole conditions. An annular compression spring actuates a telescoping sleeve which deploys a four-bar linkage and forcibly holds the linkage against the casing wall. Rollers on the ends of two of the linkages contact the casing wall for aiding in limited longitudinal movement of the tubular housing once the linkages are deployed. Gradual radial adjustment of the linkage is permitted by a fluid bleed to permit the telescoping sleeve to slowly retract during this movement. If the bleed fails and additional radial movement is continues, a pin will shear, fully releasing the telescoping sleeve and linkage from the compression spring.

In summary, both Grable and Cognevitch disclose apparatus which:

- rely upon compression spring force alone to drive and hold the linkages radially outwardly;
- do not deploy or extend the linkage until after installation on the casing;
- result in an irreversible deployment; and
- in the case of Grable do not permit movement or removal without damage to the linkage, and in the case of Cognevitch, limited movement is permitted but if the linkage cannot accept the movement required, a jarring action will shear a pin and irreversibly separate the compression spring from the linkage.

Therefore, for well tools which require secure stabilization within the casing, there is a demonstrated for a device which is capable of providing a stabilizing force which is greater than that provided by spring force alone, yet is still capable of being moved within the casing without irreversible damage to the apparatus.

SUMMARY OF THE INVENTION

Stabilizing apparatus is provided for securely stabilizing downhole tools suspended from production tubing containing fluid under varying pressure. The tool is associated with or is the source of lateral movement within the casing.

The novel apparatus utilizes fluid pressure to actively and forcefully stabilize the tool. Further, when the fluid pressure diminishes, such as when no fluid is being produced, the apparatus may be readily repeatably installed or removed without irreversible alteration of the apparatus. The apparatus is dynamically responsive so as to provide greater stabilizing force at higher fluid pressures, for instance, in the case of a PC pump tool, when the pump is pumping more vigorously.

In a broad aspect of the invention, stabilizing apparatus is connected to a well tool, such as a PC pump, suspended from the bottom of a production tubing. The apparatus comprises a tubular body having a cylindrical wall, a longitudinal bore contiguous with the production tubing. Three or more circumferentially-spaced linkages are disposed in longitudinal slots formed in the exterior of the tubular body. Each linkage comprises at least a passive link pivoted from the body and an active link. The passive and active links are pivotally connected end-to-end in series. When actuated longitudinally, the active link causes the linkage to expand radially and contact the casing. The linkage is actuated through a connection to a piston longitudinally movable within a piston bore or annulus formed in the cylindrical wall of the tubular body. The linkage is biased radially outwards, preferably using a coiled compression spring positioned longitudinally in-line and bearing against the annular piston. The annulus is connected to the longitudinal bore so that it is pressurized dynamically with fluid. The fluid pressure acts upon the piston to actuate the active link and in turn force the linkage radially outwards, the radial force being proportional with the fluid pressure.

Preferably, the tubular body is provided in two parts to facilitate formation and installation of the annulus, annular piston and spring. Further, it is preferable that the linkage comprise three links connected end-to-end in series wherein an intermediate link pivotally connecting the active link to the passive link. More preferably, a fourth link is provided being pivotally connected between the tubular body and the intermediate link and in parallel with the passive link.

DETAILED DESCRIPTION OF THE PREFERRED EMBODIMENT

Figure 1:
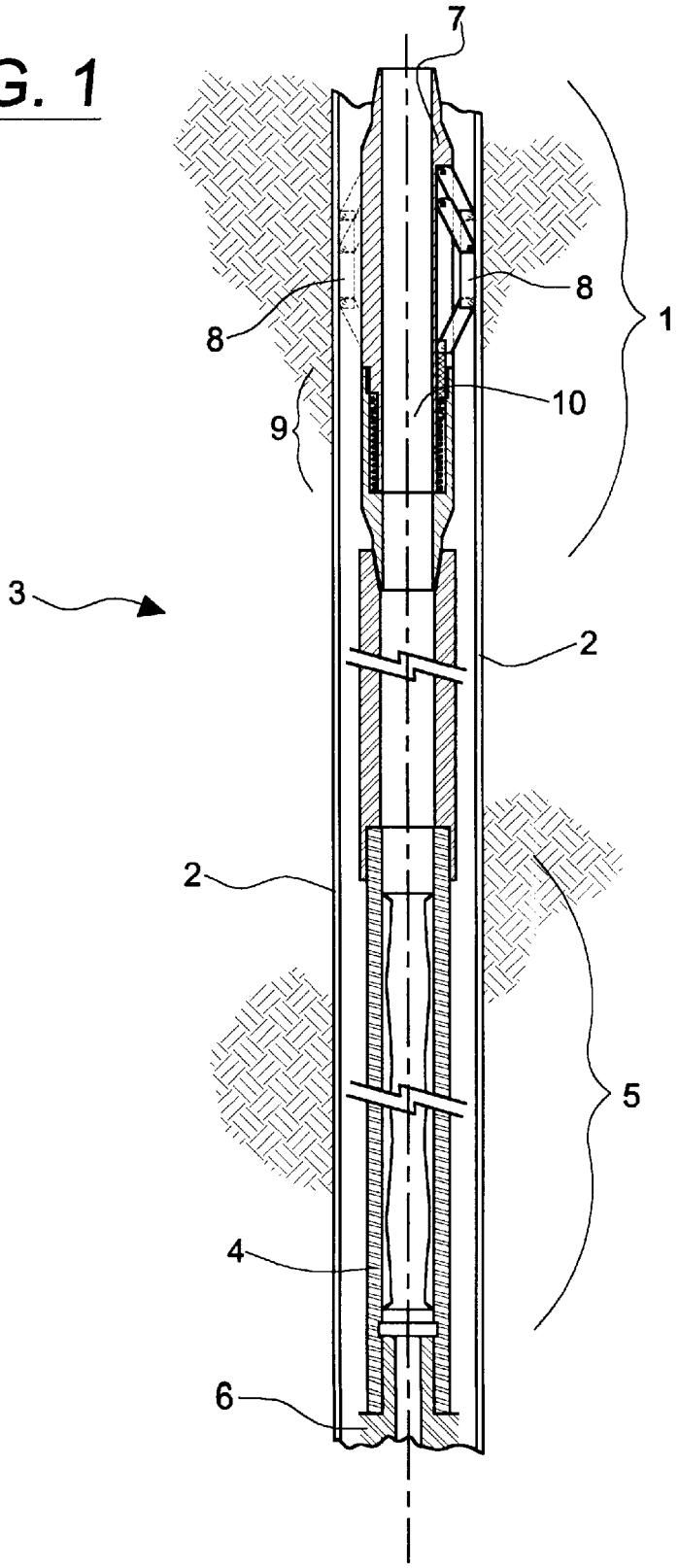
FIG. 1 is cross-sectional view of the lower end of a well casing with the stator of a PC pump suspended from production tubing and anchored to the casing, the pump having a stabilizer of the present invention connected thereabove for stabilizing the pump within the casing.

Having reference to FIG. 1, a stabilizer 1 is located concentrically within the casing 2 of a completed oil well 3. The stabilizer is connected to a downhole well tool. In this embodiment, the stabilizer 1 is connected co-axially and in-line to the stator 4 of a progressive cavity pump ("PC pump") 5. The PC pump is located concentrically within the well casing 2. The PC pump is suspended from a production string (not shown) by connection through the stabilizer 1. In operation, the PC pump pressurizes well fluids and directs them up the bore of the production tubing to the surface.

The pump stator 4 is secured against reactive torque rotation, relative to the well casing 2, using a no-turn tool 6 (partially shown). The rotor of the PC pump is not shown for clarity. The rotor is typically suspended and rotationally driven from sucker rod, also not shown.

The stabilizer 1 comprises a tubular body 7, stabilizing linkages 8 and fluid-pressure actuating means 9. The tubular body 7 has a longitudinal bore 10 for passing well fluids pumped from the PC pump 5, through bore 10 towards the surface. The bore 10 is contiguous with the bore of the production tubing.

FIG. 1 demonstrates the stabilizer 1 having linkages 8 extended radially to engage the casing 2. The stabilizer linkages 8 are braced against the casing 2 and substantially arrest oscillatory movement of the PC pump stator 4.

Figure 2:
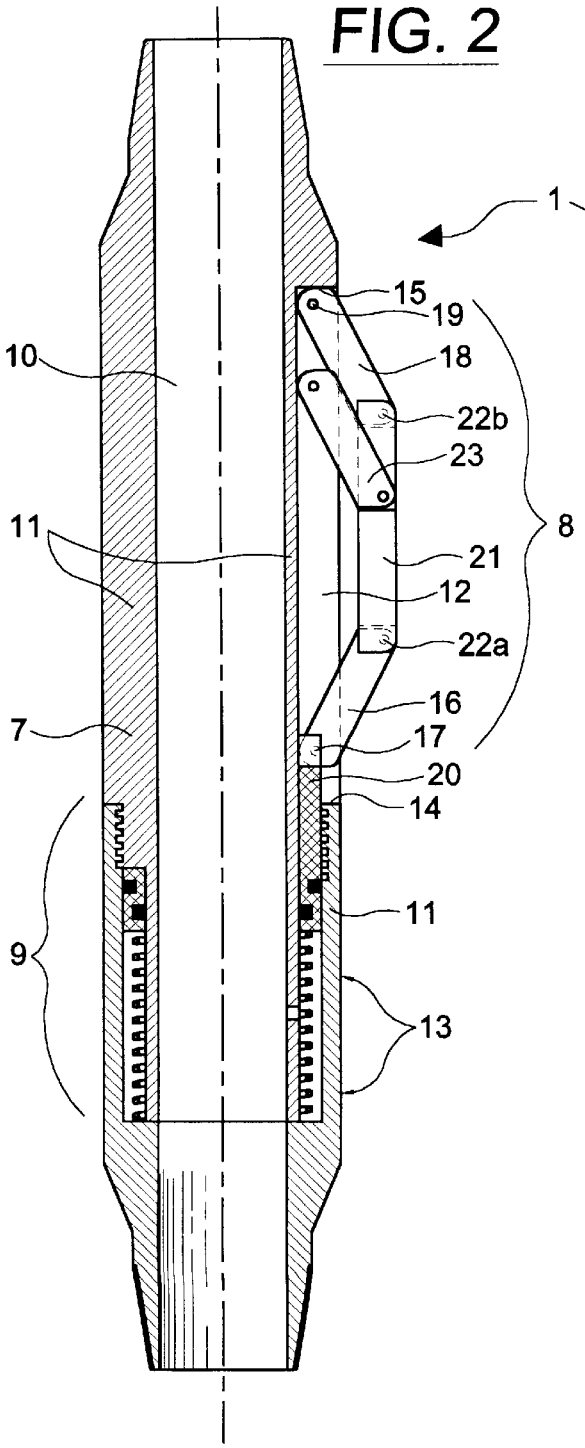
FIG. 2 is a cross-sectional view of the stabilizer of FIG. 1 showing one of the extended linkages.
Figure 3:
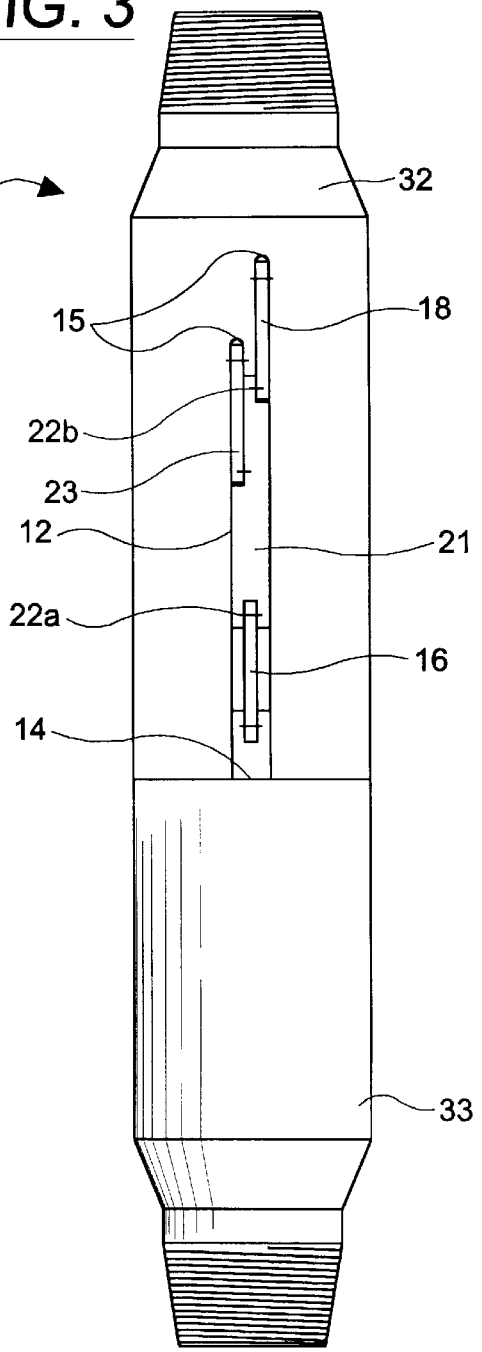
FIG. 3 is a side view of the stabilizer of FIG. 2, rotated 90°.
Figure 4:
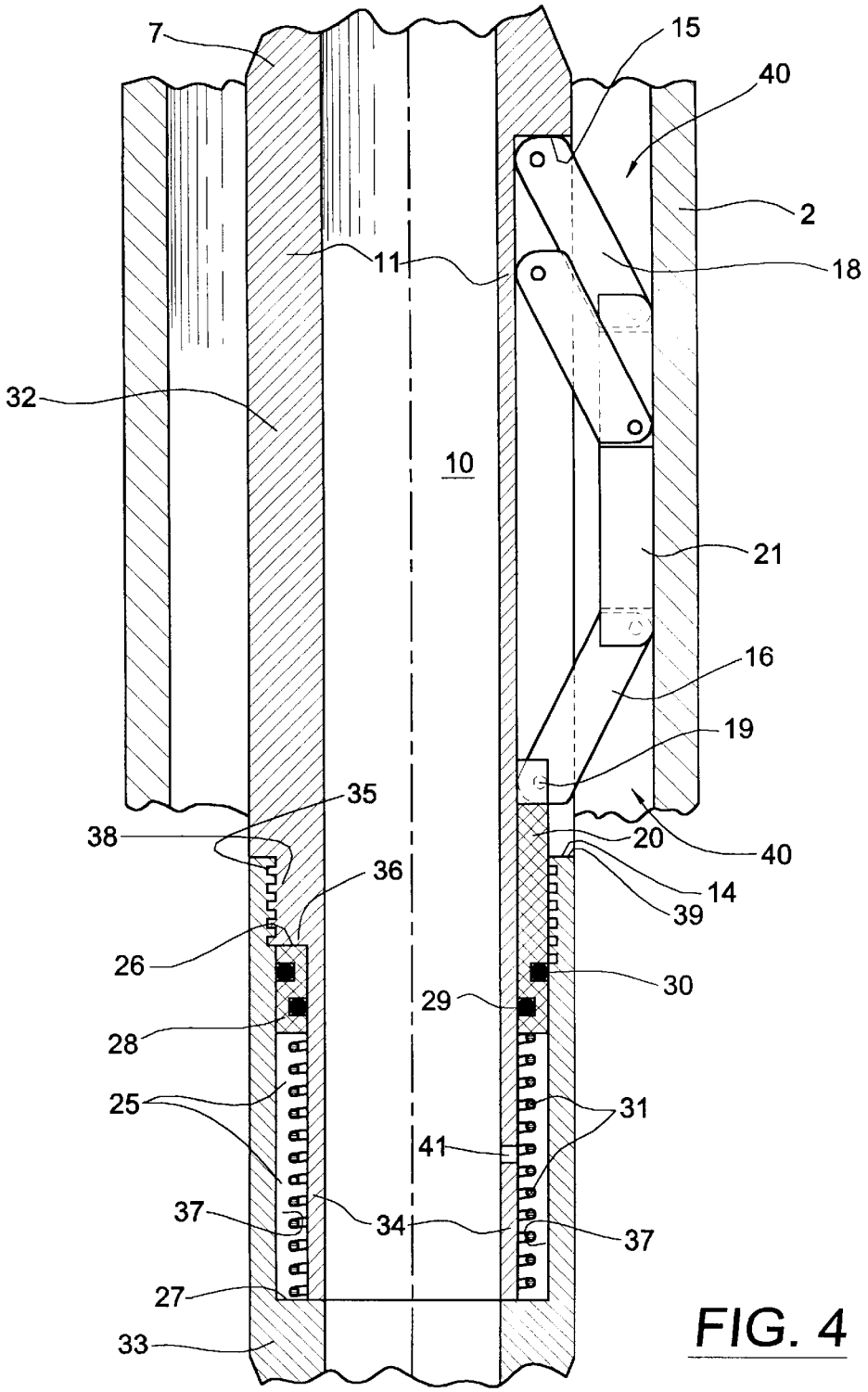
FIG. 4 is partial cross-section view of the stabilizer of FIG. 2 showing greater detail of the pressure actuating means.

Having reference now to FIGS. 2, 3 and 4 the stabilizer 1 components are discussed is greater detail.

Generally, as seen in FIGS. 2 and 3, the stabilizer 1 comprises the tubular body 7 having a plurality of linkages 8 extending radially from the body 7 for engaging the casing 2. The tubular body 7 has a cylindrical wall 11 through which is formed the longitudinal bore 10. A plurality of longitudinally extending slots 12 are formed in cylindrical wall 11, extending radially inwardly from the outer surface 13 of the body 7. The slots 12 have first and second ends 14,15.

For maintaining concentricity within the casing 2, at least three slots 12 and correspondingly linkages 8 are provided. Accordingly, the slots 12 are spaced circumferentially about the body 7, such as three slots at 120° positions. Note that only one slot 12 depicted, the other two slots and linkages not normally being visible in the views presented in FIGS. 2 and 3. For illustrative purposes only, a second linkage 8 is depicted in hidden lines in FIG. 1 to demonstrate the stabilizer's centralising effect.

Each linkage 8 is disposed within a slot 12 and is radially expandable. Each linkage 8 comprises individual link members which are pivotally-connected end-to-end together in series. A first active link 16 is pivotally connected at a first pivot point 17 located at the first end 14 of the slot 12. The first pivot point 17 pivotally connects the active link 16 to a linkage-actuating member 20. A second passive link 18 is pivotally connected at a second pivot point 19 to the tubular body 7 at the slot's second end 15. The active and passive links 16, 18 are pivotally connected by a third intermediate link 21 at pivot points 22*a* and 22*b*.

Basically, as the actuating member 20 is advanced longitudinally along the slot 12, then the active link 16 is directed to approach the passive link 18. As a result, the intermediate link 21 is driven radially outwardly to contact and press against the casing 2. If the active link 16 is actuated to withdraw from the passive link 18, the intermediate link 21 is drawn back radially inwardly towards the wall 11.

In a small diameter implementation of the stabilizer, employing a thin cylindrical wall 11, it may not be possible to geometrically position all four of the pivot points 19, 22*b*, 22*a* and 17 so as to avoid an overcentering and jamming of the intermediate link 21 during actuation. For example, pivot point 22*b* may remain tight to wall 11 while pivot 22*a* expands radially outwardly thereby imposing a point load on the casing 2. Accordingly, it is preferable to employ a fourth link 23, parallel to the passive link 18 to form a parallelogram linkage. Like the passive link, the fourth link 23 is pivotally connected to the tubular body 7 and to the intermediate link 21. As seen in FIG. 3, to avoid interference between the passive link 18 and the fourth links 23 when they retract to the wall 11, said links 18, 23 are slightly staggered circumferentially. The intermediate link 21 is milled accordingly to allow for proper function.

As seen in better detail in FIG. 4, actuation of the linkage 8 is performed with pressure-actuating means 9. A piston and piston bore arrangement actuates the actuating member 20. More particularly, a longitudinally-extending annulus 25 is formed within the cylindrical wall 11. The annulus 25 has a first end 26 connected to the slot's first end 14. The annulus 25 is closed at its second end 27. An annular piston 28 is disposed and is longitudinally movable between the first and second ends 26, 27 of the annulus 25. The piston 28 has an inside O-ring seal 29 and an outside O-ring seal 30 for forming a pressure chamber within the annulus 25. The seals 29, 30 separate the annulus 25 and longitudinal bore 10 from the slots 12.

The actuating members 20 extend longitudinally from the piston 28 for connection to the first pivot point 17 of the active link 16.

A coil compression spring 31 is disposed within the annulus 25 and bears against the annulus's second end 27.

The spring 31 biases the piston 28 towards the annulus's first end 26. The piston 28 actuates the active link 16 which in turn causes the linkage 8 to expand radially and contact the casing 2.

The annulus 25, annular piston 28 and spring 31 must be installed in some manner. As shown in FIGS. 3 and 4, the tubular body 7 is formed by the mating of two housings; a first housing 32 bearing the slots 12 and linkages 8; and a second housing 33. The first housing 32 has a cylindrical protrusion 34 with external threads 35 at the base 36 of the protrusion 34. The second housing 33 forms a cylindrical cavity 37 for accepting the cylindrical protrusion, the cavity having internal threads 38 at opening 39 to the cavity for mating with the base's external threads 35. When the first and second housings 32, 33 are threaded together, the annular space formed between the protrusion 34 and the cavity 37 form the annulus 25.

Prior to assembling the first and second housings 32, 33, the coil spring 31 and annular piston 28 are installed. The base 36 of the first housing's protrusion 34 forms a stop against which the annular piston 28 rests, restraining the piston within the annulus 25.

The actuating members 20 comprise longitudinal bar extensions protruding from the annular piston 28 and which project into the slots' second ends 15.

The pre-load energy in the spring 31 is sufficient to cause the linkages 8 to engage the casing 2 and centralise the stabilizer 1 and PC pump stator 4 during installation. The spring pre-load is not so strong as to prevent the linkage 8 from deflecting radially inwardly when an obstruction or radial deviation in the casing is encountered. Advantageously, the active and passive links 16, 18 present a sloped leading face 40 for readily mounting and deflecting over such casing deviations.

The spring pre-load alone is too weak to properly stabilize the PC pump during pumping operation. Accordingly, the pressure actuating means 9 is provided as dynamic means which makes the stabilizing capability stronger as the fluid pressure in the longitudinal bore increases.

The pressure actuating means 9 comprises the annular piston 28, a piston bore or the annulus 25, and a fluid passageway 41 located between the longitudinal bore and the annulus 25 between the piston and the annulus's second end 27. Fluid pressure within the longitudinal bore 10 causes the annular piston 28 to move towards the annulus's first end 26. The actuating members 20 are correspondingly caused to move longitudinally, actuating the active link 16.

The greater is the bore's fluid pressure, the greater is the force applied to the active link 16 and the greater is the force applied by the linkage 8 on the casing 2. Serendipitously, as the PC pump works harder and results in greater vibration, the bore pressure also increases and the linkages 8 provide greater stabilizing force.

When it is necessary to move the PC pump in the casing, pumping is stopped and the pressure differential between the bore and the casing annulus falls. The force of the linkage against the casing correspondingly reduces to that provided by the spring force alone, facilitating easy release of the linkage and corresponding ease of pump movement or removal.

For example, using a stabilizer tool which is adapted to 3½" tubing and 7" casing, sufficient wall thickness is available to provide an annular piston having a total fluid area of about 5 square inches. With a fluid pressure in the bore of 1000 psi, the net actuating force on the piston is about 5,000 pounds. This translates into in a radial force at the linkages of about 4000 pounds. When the pump is not pumping, such as during installation or removal, the pressure within the bore falls. Accordingly, the spring will continue to provide about 50–100 pounds of force at the linkage, sufficient to centralise the pump stator, but not so as to restrict removal of the tools. Note that the force of the linkage while pumping is in the order of 40 times greater than that provided by the spring force alone.

The embodiments of the invention in which an exclusive property or privilege is claimed are defined as follows:

1. Apparatus for stabilizing a well tool concentrically within a subterranean casing, the well tool being suspended from a production tubing string containing well fluid comprising:

a tubular body having a longitudinal bore in communication with the fluid in the production tubing, a cylindrical wall and an outer surface facing the casing, at least one end of the body which connects co-axially in-line to the well tool;

three or more slots extending longitudinally along the cylindrical wall and being formed radially inwards from the body's outer surface, said slots being spaced circumferentially about the body, each slot having first and second ends;

a radially expandable linkage disposed within each slot, each linkage comprising two or more members pivotally connected end-to-end in series and having at least a first pivot point longitudinally movable within the first end of the slot and a second pivot point pivoted from the tubular body at the second end of the slot wherein actuation of longitudinal movement of said first pivot point causes radial movement of the linkage;

an longitudinally extending annulus formed within the cylindrical wall and having first and second ends, the first end of the annulus being adjacent and in communication with the first end of the slots;

an annular piston disposed and longitudinally movable between the first and second ends of the annulus;

means for sealing the annular piston to the annulus to permit a differential pressure to be formed between the annulus and the slot;

actuating members extending between the annular piston and the first pivot point of the linkage;

biasing means for normally expanding the linkage radially outwards; and a fluid passageway between the longitudinal bore and the second end of the annulus wherein fluid pressure within the bore causes the annular piston to move from the annulus's second end towards the annulus's first end, the actuating members causing the linkage's first pivot point to move longitudinally towards the second pivot point, the result being a outwardly radial movement of the linkage, the radial force produced at the linkage being proportional to the fluid pressure in the bore.

2. The apparatus as cited in claim 1 wherein the tubular body comprises the mating of first and second housings, the first housing having a longitudinal cylindrical protrusion extending from a base and having external threads at the base, and the second housing having a longitudinally extending cavity for accepting the cylindrical protrusion and having internal threads for mating with the base's external threads, the protrusion and cavity forming the annulus within which the annular piston moves.

3. The apparatus as cited in claim 2 wherein the well tool being stabilized is a fluid pump.

4. The apparatus as cited in claim 3 wherein the pump is a progressive cavity pump.

5. The apparatus as cited in claim 3 wherein each linkage comprises three links connected end-to-end in series having an active link connected at the first pivot point, a passive link connected at the second pivot point and an intermediate link pivotally connecting the active link to the passive link.

6. The apparatus as cited in claim 5 wherein the linkage further comprises a fourth link being pivotally connected to the tubular body and to the intermediate link and in parallel with the passive link.

7. The apparatus as cited in claim 6 wherein the biasing means comprises a coil spring situated in the annulus between the annular piston and the annulus's second end.

8. The apparatus as cited in claim 7 wherein the sealing means comprise O-rings sealing between the piston and the annulus.

* * * * *